US008965034B2

(12) United States Patent
Ueda et al.

(10) Patent No.: US 8,965,034 B2
(45) Date of Patent: Feb. 24, 2015

(54) SUSPENSION STRUCTURE

(75) Inventors: Minoru Ueda, Tokyo (JP); Naoki Tsushima, Tokyo (JP); Takayuki Kumagai, Tokyo (JP)

(73) Assignee: Namiki Seimitsu Houseki Kabushiki Kaisha, Tokyo (JP)

( * ) Notice: Subject to any disclaimer, the term of this patent is extended or adjusted under 35 U.S.C. 154(b) by 534 days.

(21) Appl. No.: 12/669,327

(22) PCT Filed: Jul. 18, 2008

(86) PCT No.: PCT/JP2008/062989
§ 371 (c)(1),
(2), (4) Date: Jan. 15, 2010

(87) PCT Pub. No.: WO2009/011416
PCT Pub. Date: Jan. 22, 2009

(65) Prior Publication Data

US 2010/0189304 A1 Jul. 29, 2010

(30) Foreign Application Priority Data

Jul. 19, 2007 (JP) ..... 2007-188367

(51) Int. Cl.
*H04R 25/00* (2006.01)
*B06B 1/04* (2006.01)
*H04R 11/02* (2006.01)

(52) U.S. Cl.
CPC ..... *B06B 1/045* (2013.01); *H04R 11/02* (2013.01)
USPC ..... 381/396; 381/398; 381/412

(58) Field of Classification Search
CPC ..... H04R 9/06; H04R 7/20; H04R 7/18; H04R 7/16; H04R 2307/207; H04R 31/003; H04M 19/047; G10K 9/13
USPC ..... 381/396, 398, 400, 401, 403, 404, 412, 381/151, 431; 340/388.1, 407.1; 181/171, 181/172; 29/594
See application file for complete search history.

(56) References Cited

U.S. PATENT DOCUMENTS 6,529,611 B2 * 3/2003 Kobayashi et al. ..... 381/396
6,553,125 B2 * 4/2003 Kobayashi et al. ..... 381/396
7,082,668 B2 * 8/2006 Ando et al. ..... 29/594

FOREIGN PATENT DOCUMENTS

JP 11-069488 3/1999
JP 2000-201396 A 7/2000

OTHER PUBLICATIONS

International Search Report; PCT/JP2008/062989; Sep. 2, 2008.

* cited by examiner

*Primary Examiner* — Huyen D Le
(74) *Attorney, Agent, or Firm* — Studebaker & Brackett PC

(57) ABSTRACT

[Problems] To provide a multifunction vibration actuator which has flat rising and falling frequency characteristic at the time of generation of bodily sensation vibration and which is stable for an input signal.
[Means for Solving Problems] Flat frequency characteristics can be obtained by using a two-fold rotational symmetry frame type suspension, and miniaturization of the whole multifunction vibration actuator can be made by the user of the frame type suspension. With regard to the frame type suspension, use of protruded configuration of corner parts ensures the effect of absorption of deflection of the suspension.

2 Claims, 7 Drawing Sheets

SUSPENSION STRUCTURE

TECHNICAL FIELD

The present invention relates to a multifunction vibration actuator using a frame-shaped suspension.

Currently, in a mobile communication device represented by a mobile telephone or the like, a multifunction vibration actuator having a sound reproduction function for reproducing a ring tone by a diaphragm including a voice coil attached thereto at the time of an incoming call and a vibration generation function for generating bodily sensation vibration by a magnetic circuit unit including a magnet attached thereto is widely used.

As such a multifunction vibration actuator, a structure described in Japanese Patent No. 2930070 (hereinafter, referred to as Patent Document 1), in which a rectangular housing, a cylindrical voice coil and a magnet are combined such that a corner part of a magnetic circuit unit is used as a weight part, thereby obtaining bodily sensation vibration.

In addition, in a structure described in Japanese Unexamined Patent Application Publication No. 2000-201396 (hereinafter, referred to as Patent Document 2), a sound radiation area is set to be wide by a track-shaped housing and a magnetic circuit unit such that sound pressure higher than that of a conventional cylindrical multifunction vibration actuator is obtained and a space is saved by using the track shape.

In addition, the multifunction vibration actuator described in Patent Document 2, a suspension for supporting the magnetic circuit unit has a track shape, and, by increasing a dimension in a longitudinal direction, magnetic flux density can be increased even when the width of the track shape is narrowed.

[Patent Document 1] Japanese Patent No. 2930070

[Patent Document 1] Japanese Unexamined Patent Application Publication No. 2000-201396

DISCLOSURE OF THE INVENTION

Problems to be Solved by the Invention

However, in the conventional multifunction vibration actuator represented by the above-described two Patent Documents, due to the structure of the suspension, force is applied to the magnetic circuit unit in a rotational direction at the time of generation of bodily sensation vibration.

To this end, in the structure described in Patent Document 1, a magnetic gap cannot be maintained unless the magnet mounted in the magnetic circuit unit has a disk shape. Thus, the shape of the voice coil mounted in the diaphragm is limited to the cylindrical shape.

In addition, in the structure described in Patent Document 2, due to the structure using an elliptic magnet in the magnetic circuit unit, the magnetic gap needs to be widened in correspondence with movement in the rotational direction. Accordingly, if the dimension in the longitudinal direction is increased, a dimension in a width direction should be increased.

Means for Solving the Problems

The present invention is contrived to solve the above-described problems. An object of the present invention is to provide a multifunction vibration actuator capable of suppressing rotation of a magnetic circuit unit at the time of bodily sensation vibration and easily realizing miniaturization by stable vibration.

In order to achieve the above object in a first embodiment, a multifunction vibration actuator is characterized in that a suspension having a two-fold rotational symmetry frame shape as a plane shape thereof is used.

In detail, the multifunction vibration actuator of the present invention does not use a suspension structure for elastically supporting a magnetic circuit unit by independently extending arms, but uses a suspension structure for supporting the magnetic circuit unit on an inner wall of a housing by a corner part having a two-fold rotational frame shape.

By using the frame-shaped suspension structure, in the multifunction vibration actuator of the present invention, a space of the suspension in the housing can be saved. In addition, it is possible to suppress rotation of the magnetic circuit unit, which is generated in the conventional multifunction vibration actuator.

In addition, by using the two-fold rotational symmetry shape, a pair of arms of the frame-shaped suspension for supporting the magnetic circuit unit in an opposing direction is elastically deformed at the time of generation of bodily sensation vibration. Thus, it is possible to obtain stable vibration characteristics, of the amplitude which is not limited by the shape of the magnetic circuit unit, and to adjust the vibration characteristics by changing the shapes of the adjacent arms.

The invention in a second embodiment is characterized in that a structure in which a magnetic circuit unit supporting part is disposed at a two-fold rotational symmetry position, unlike the structure in which the suspension has the rotational symmetry structure in the invention.

To this end, even in the structure using the frame-shaped suspension instead of the two-fold rotational symmetry shape as the plane shape thereof, by using the invention described in the second embodiment, it is possible to adjust the vibration characteristics. In addition, even when a linearly symmetrical shape without deviation is used with respect to the arm of the suspension, the space of the suspension can be further saved.

The invention of the first embodiment or second embodiment is further characterized in that, in the frame-shaped suspension used in the invention, a corner part has a protruded shape. To this end, the corner part can absorb deflection of the suspension occurring at the time of generation of bodily sensation vibration in the multifunction actuator described.

As described above, by using the multifunction vibration actuator described in the present invention, it is possible to obtain a small-sized multifunction vibration actuator capable of easily configuring a certain shape such as a square shape, as compared with the conventional multifunction vibration actuator.

Embodiment

Hereinafter, the exemplary embodiments of the present invention will be described with reference to FIGS. 1 to 7.

FIG. 1 is a perspective view of a multifunction vibration actuator used in the present embodiment. As can be seen from FIG. 1, the multifunction vibration actuator used in the present embodiment has substantially a rectangular plane shape such that a mounting space is saved at the time of mounting of a substrate.

FIG. 2 is a side cross-sectional view taken along line a-a' of FIG. 1, and FIG. 3 is an exploded perspective view of the multifunction vibration actuator shown in FIG. 1.

As can be seen from FIG. 1, FIG. 2 and FIG. 3, the multifunction vibration actuator described in the present embodiment has a dynamic structure in which a sound reproduction unit including a center cap 1, a diaphragm body 2 and a voice coil 3 and a magnetic circuit unit including a pole piece 4, a magnet 5, a yoke 6 and a suspension 7 are attached to a housing 8, the magnetic circuit unit is contained in a cover 9, and an input to the voice coil 3 through a contact terminal 10 formed in the housing 8 is performed.

To this end, a sound reproduction function according to the sound reproduction unit and a bodily sensation vibration generation function according to vibration of the magnetic circuit unit may be appropriately used by an input frequency.

In addition, the suspension 7 has a two-fold rotational symmetry frame shape structure in which a yoke attachment part 7*b* and a housing attachment part 7*e* are elastically supported by frame-shaped arms.

In addition, with respect to the sound reproduction unit, deflection occurring in the corner part is absorbed by forming a V groove c in a diaphragm corner part, and rigidity of the diaphragm is increased by using a double structure in which the center cap 1 is attached to the diaphragm body 2, and reproduced sound with low distortion, which is capable of suppressing split vibration at the time of reproduction of sound, is obtained.

FIG. 5 shows a voice coil attachment part of the diaphragm shown in FIG. 3.

As can be seen from FIG. 5, FIG. 2, and FIG. 3, the multifunction vibration actuator used in the present embodiment uses a structure in which the voice coil 3 protrudes from immediately below the center cap 1 by using a voice coil attachment part d formed immediately below the center cap 1 at the time of attachment of the voice coil to the sound reproduction unit.

In addition, the magnetic circuit unit has a structure in which an outer edge of the yoke 6 is cut out, the magnet 5 and the pole piece 4 are contained in the yoke 6, and a frame-shaped suspension attachment part 6*b* is formed in the cutout portion.

By using the above structure, the multifunction vibration actuator of the present embodiment can higher reproduction sound pressure than that of the conventional multifunction vibration actuator, of the voice coil diameter which is limited by the center of the diaphragm.

In addition, even in the magnetic circuit unit, it is possible to obtain a larger vibration amount than that of the conventional vibration actuator, of the magnet diameter which is limited by the inner diameter of the yoke.

In addition, from the same technical viewpoint, the diaphragm has a structure in which the voice coil attachment part d is not formed and the voice coil 3 is directly attached to a flat portion of the diaphragm body 2 facing the center cap. Accordingly, if the above structure is used, it is possible to suppress the thickness dimension of the diaphragm and to increase the number of turns of coil.

In addition, as can be seen from FIG. 2, in the present embodiment, a bottom of the yoke 6 protrudes in a lateral direction. To this end, a bottom of the housing functions as a stopper of the yoke at the time of the shock such as dropping (see f of FIG. 2), collision between the voice coil 3 and the yoke 6 can be prevented, the lateral dimension of the yoke 6 can be increased so as to increase the vibration amount at the time of generation of bodily sensation vibration.

FIG. 6 is a perspective view of the suspension 7 which is deformed at the time of driving of the magnetic circuit unit, in the embodiment, and FIGS. 7 and 4 are plan views of the frame-shaped suspension 7 used in the present embodiment.

FIG. 6 is a perspective view when the magnetic circuit unit is supported by the suspension having the plane shape shown in FIG. 7. By using the suspension structure described in the present embodiment, it is possible to obtain an internal structure in which a pair of arms having a symmetrical shape in an opposing direction is elastically deformed and the magnetic circuit unit is not easily rotated at the time of generation of bodily sensation vibration.

As can be seen from FIG. 7, the frame-shaped suspension 7 used in the present embodiment has a two-fold rotational symmetry-shaped structure in which the shape adjacent corner parts are changed, such that deflection occurring in the suspension 7 is absorbed at the time of generation of bodily sensation vibration by protruding the corner part and the vibration characteristics can be adjusted to an optimal state by changing the shape of the corner part.

In addition, the suspension shown in FIG. 4 has a two-fold rotational symmetry frame shape by combining an arm h and an arm having different shapes. To this end, at the time of driving of the magnetic circuit unit, it is possible to obtain optimal vibration characteristics while dispersing stress to the whole arm.

In the effect of the above-described suspension, although the two-fold rotational symmetry shape is used by changing the shapes of the arms, from the same technical viewpoint, as shown in FIG. 8, the same effect can be obtained by a structure in which the yoke attachment part b is disposed at a two-fold rotational symmetry position.

In addition to the above effect, although the square shape is used as a whole in the present embodiment, since the suspension shape is the frame shape, it is possible to correspond to a certain shape such as an elliptic shape and to easily miniaturize the whole structure. In addition, as shown in FIG. 9, since a suspension attachment part 8*e* is formed in the lower surface of the housing 8, the housing does not restrict the movement of the suspension at the time of generation of bodily sensation vibration.

As described above, by using the multifunction vibration actuator described in the present embodiment, it is possible to obtain a small-sized multifunction vibration actuator capable of easily configuring a certain shape such as a square shape, as compared with the conventional multifunction vibration actuator.

DESCRIPTION OF REFERENCE NUMERALS AND SIGNS

Figure 1:
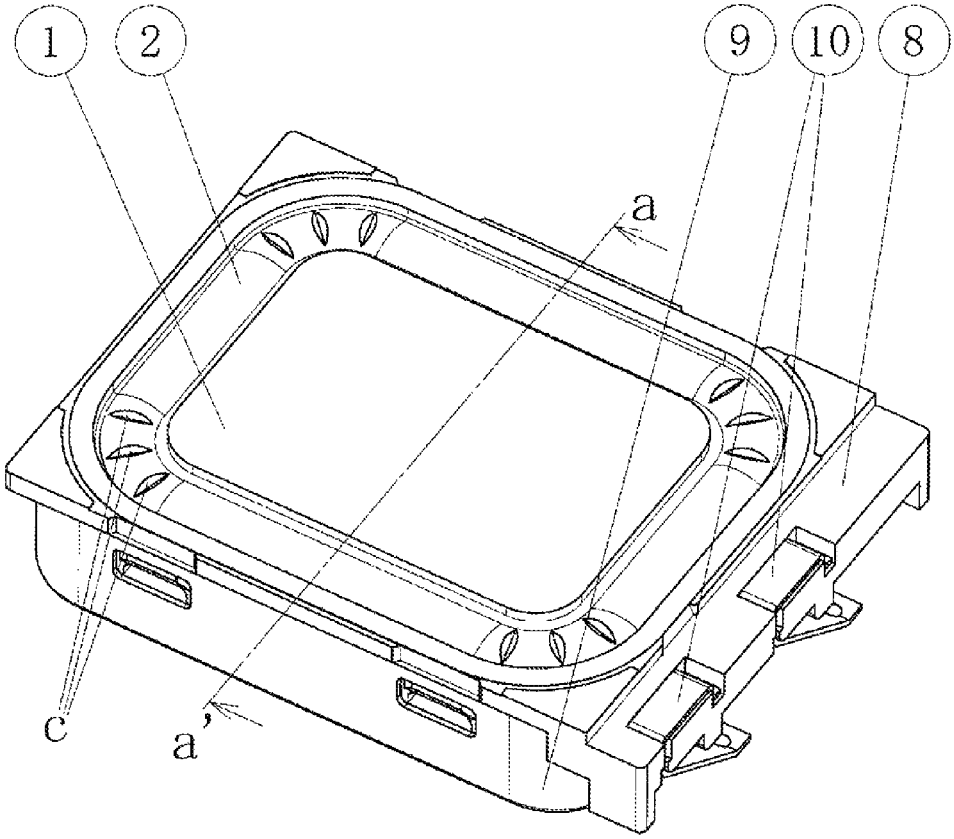
FIG. 1 is a perspective view of a multifunction vibration actuator according to the present embodiment.
Figure 2:
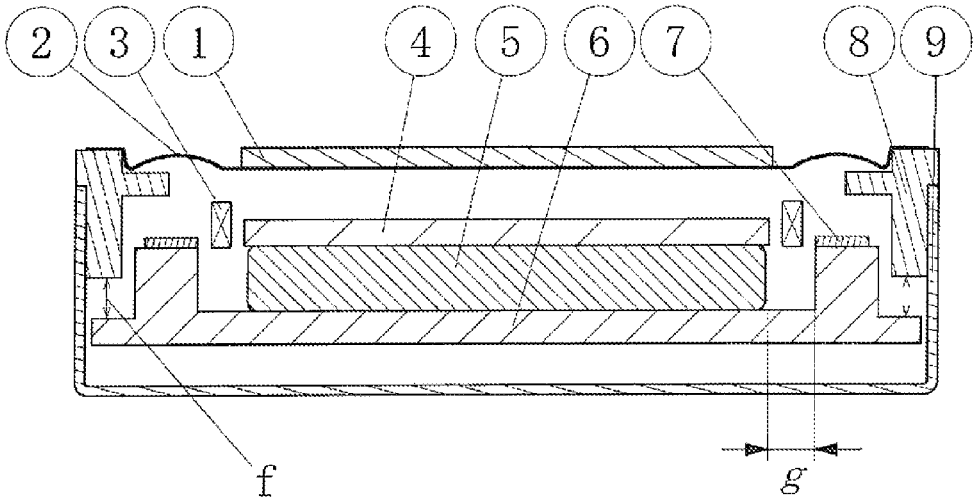
FIG. 2 is a side cross-sectional view taken along line a-a' of FIG. 1.
Figure 3:
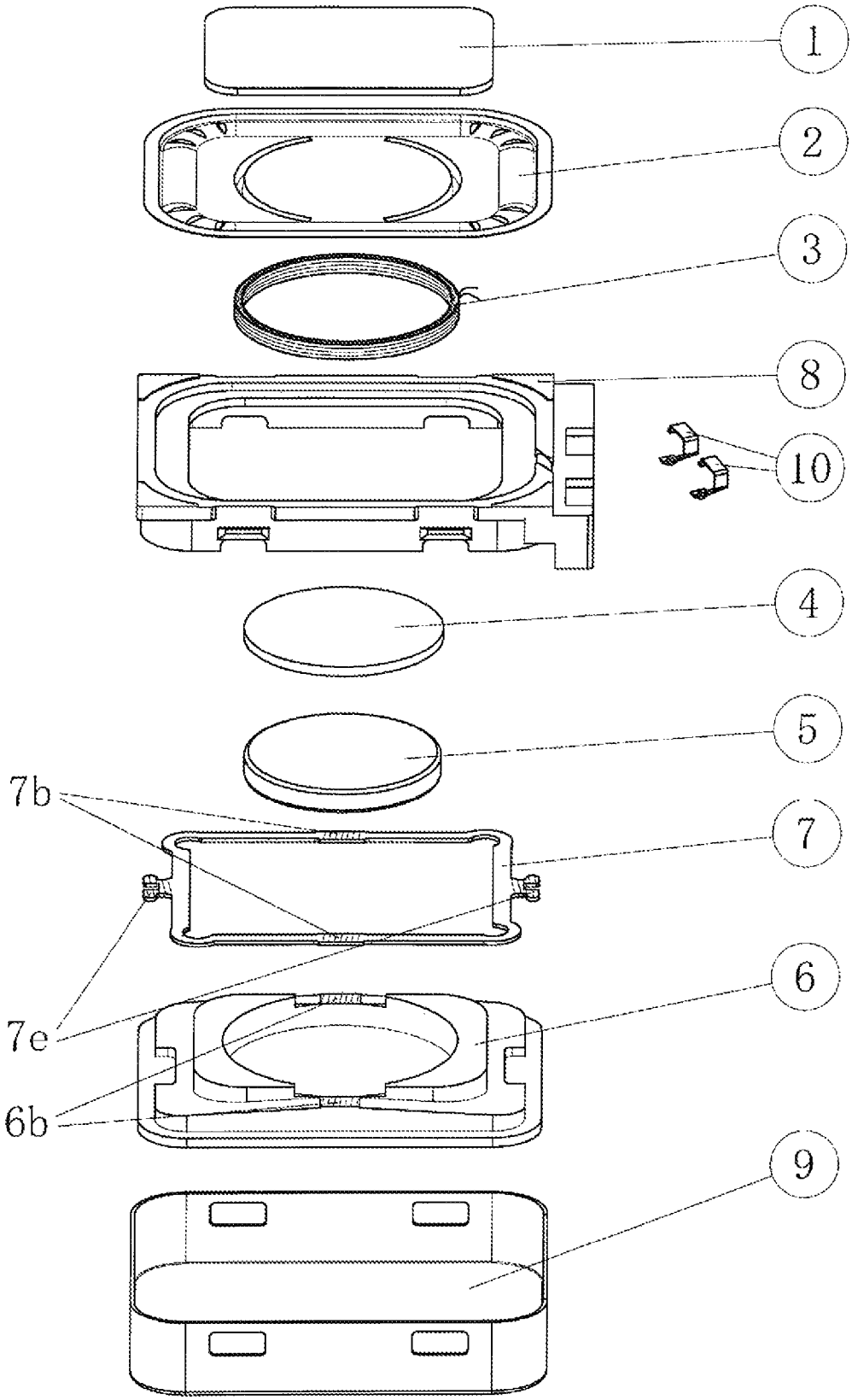
FIG. 3 is an exploded perspective view of the multifunction vibration actuator according to the present embodiment.
Figure 4:
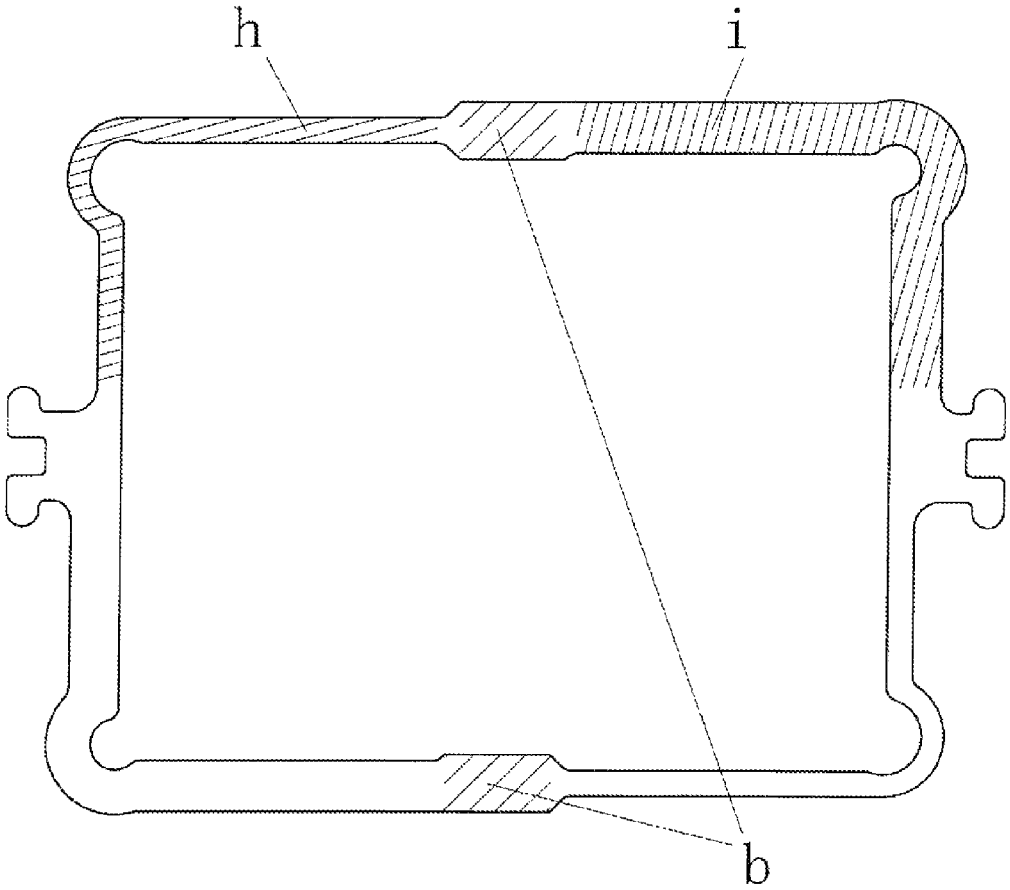
FIG. 4 is a plan view of the suspension (arm two-fold rotational symmetry shape) used in the present embodiment.
Figure 5:
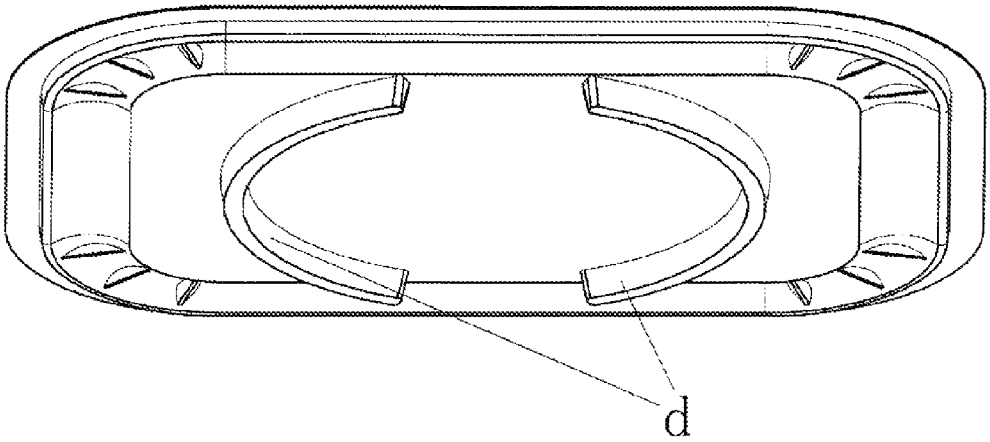
FIG. 5 is a perspective view of a lower side of a diaphragm used in the present invention.
Figure 6:
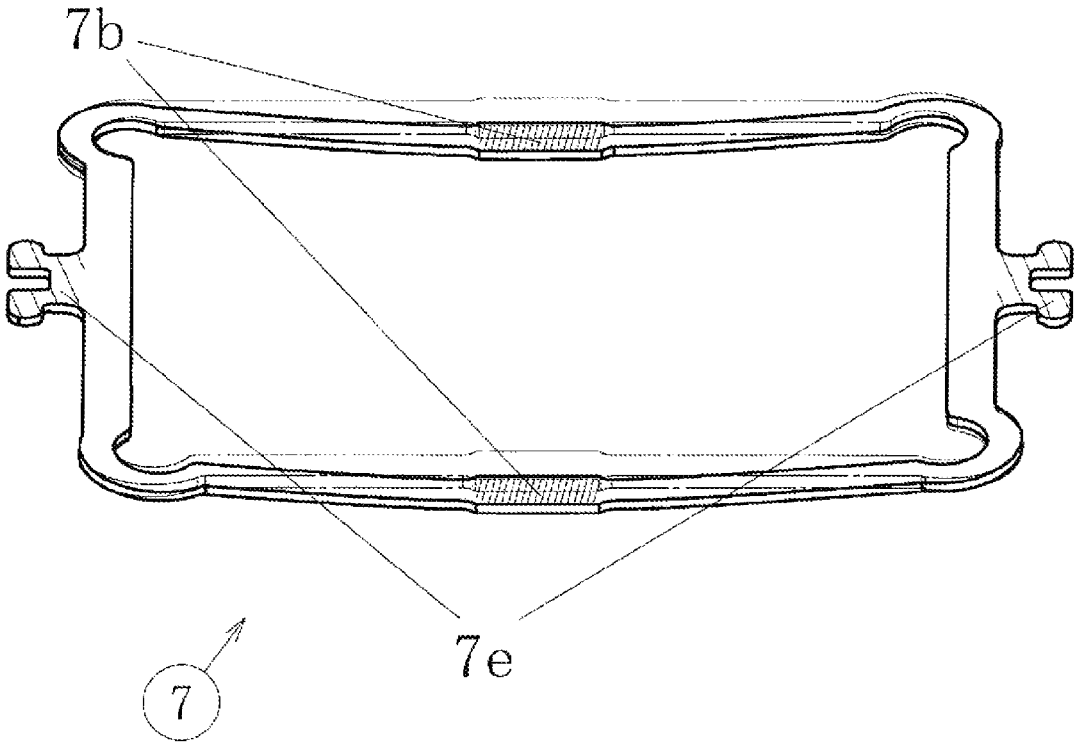
FIG. 6 is a perspective view of a suspension 7 which is elastically deformed at the time of driving of a magnetic circuit unit, in the embodiment of the present invention.
Figure 7:
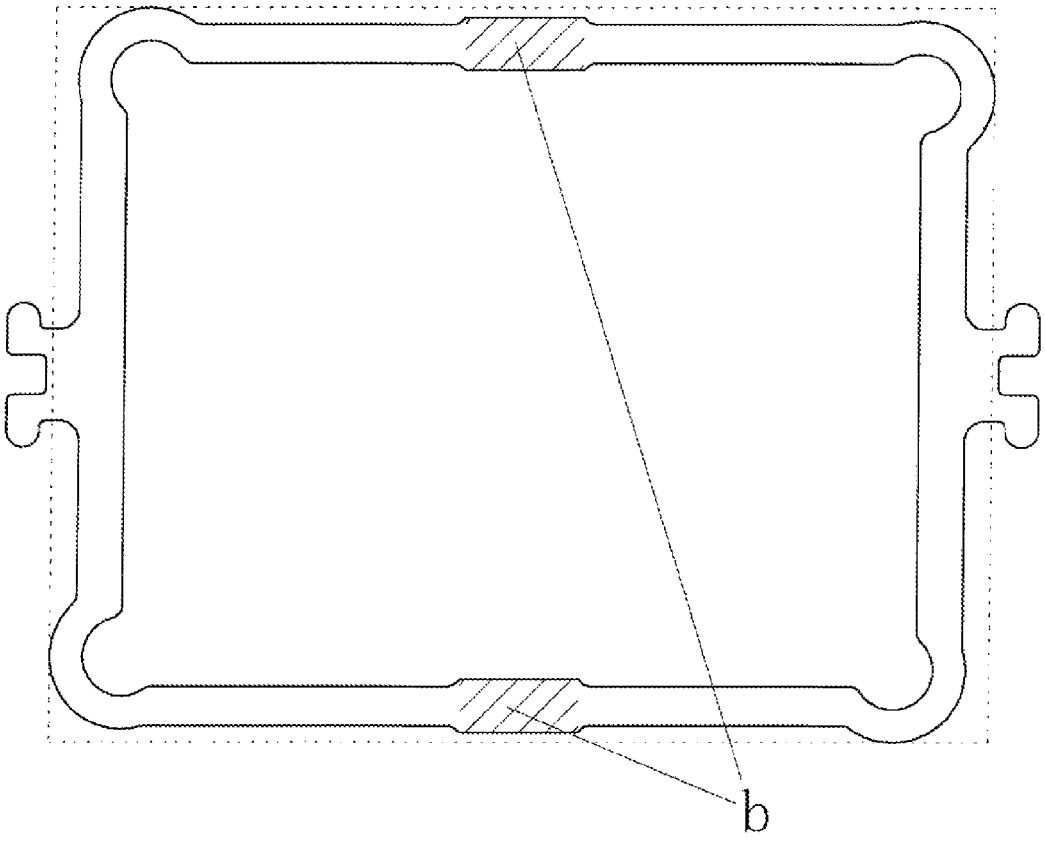
FIG. 7 is a plan view of the suspension (corner part two-fold rotational symmetry shape) used in the present embodiment.
Figure 8:
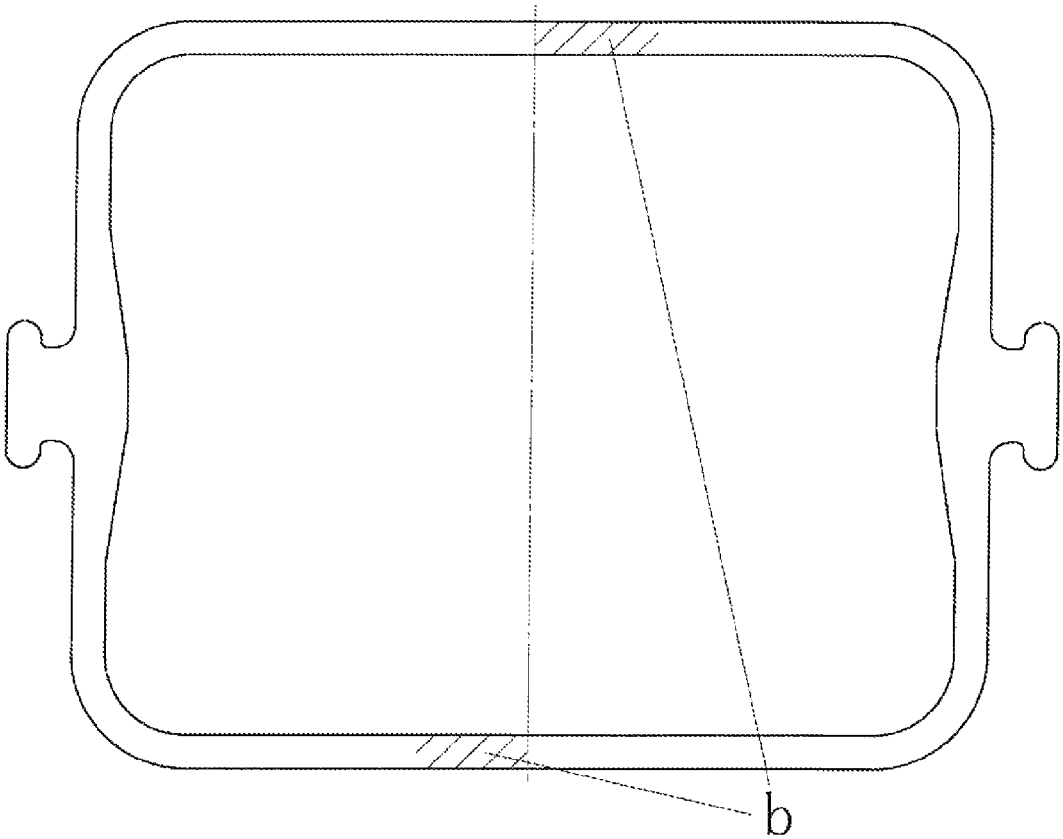
FIG. 8 is a plan view of the suspension (attachment part two-fold rotational symmetry) used in the present embodiment.
Figure 9:
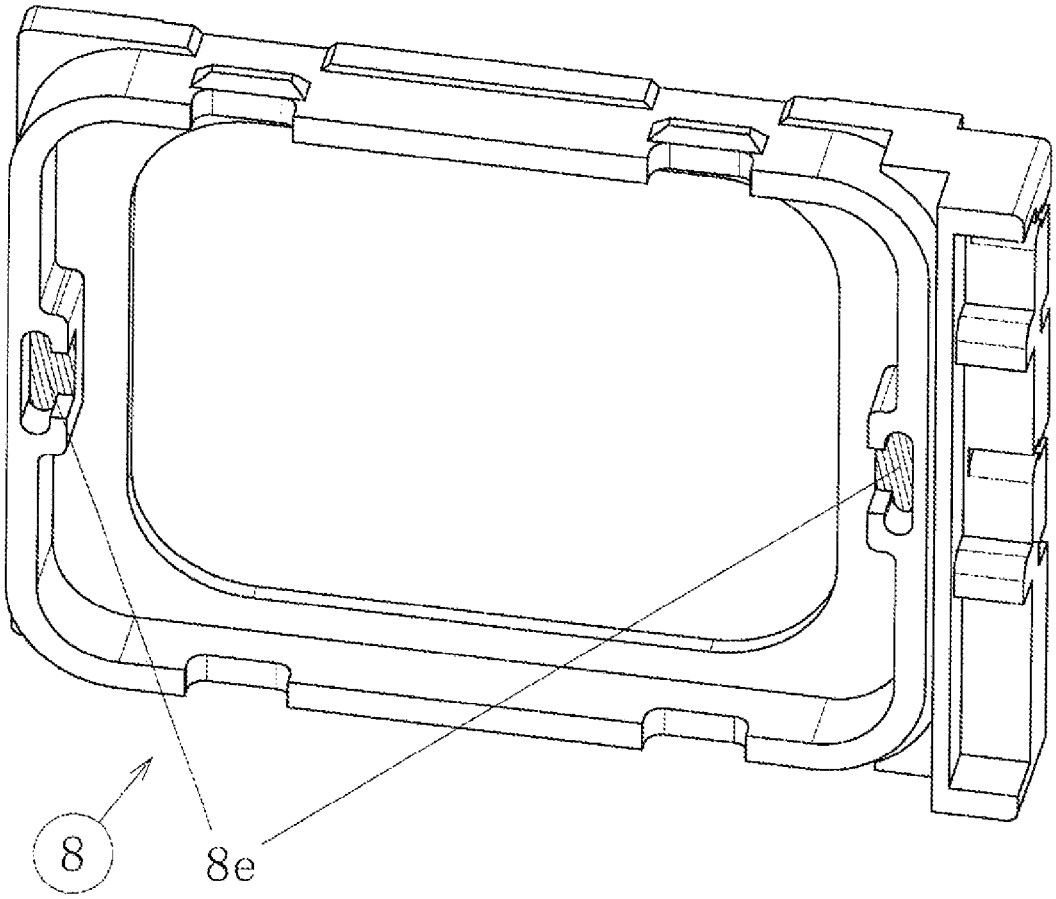
FIG. 9 is a perspective view of a lower side of a housing used in the present embodiment.

1: center cap
2: diaphragm body

3: voice coil
4: pole piece
5: magnet
6: yoke
6*b*: yoke-side suspension attachment part
7: suspension
7*b*: yoke attachment part
7*e*: housing attachment part
8: housing
8*e*: housing-side suspension attachment part
9: cover
10: contact terminal
b: yoke attachment part
c: V groove
d: voice coil attachment part
f: stopper function
g: magnetic gap
h, i: arm

What is claimed is:

1. A multifunction vibration actuator, comprising:

a sound reproduction unit configured to reproduce sound and including a diaphragm having a voice coil attached thereto, a magnetic circuit unit configured to generate bodily sensation vibration and having a magnet attached thereto, a yoke, a cylindrical shaped housing having an inner wall, and a suspension having a two-fold rotational symmetry frame shape as a plane shape thereof, wherein the suspension includes four sides connected to each other to form a frame shape, the suspension further includes two housing attachment parts, each housing attachment part is disposed on an opposite side of the four sides, each housing attachment part is to be fixed to each of two sides of the inner wall of the housing, the suspension further includes two yoke attachment parts, each yoke attachment part is disposed on a remaining opposite side of the four sides of the suspension, and each yoke attachment part is to be fixed to each of two sides of the yoke, wherein the sound reproduction unit and the magnetic circuit unit are attached to the cylindrical shaped housing, wherein the magnetic circuit unit is supported on the inner wall of the cylindrical shaped housing by the suspension, and wherein the suspension includes a first pair of diagonal arms and a second pair of diagonal arms, the first pair of diagonal arms having a different shape from the second pair of diagonal arms.

2. A multifunction vibration actuator, comprising:

a sound reproduction unit including a diaphragm having a voice coil attached thereto to reproduce sound, a magnetic circuit unit having a magnet attached thereto to generate bodily sensation vibration, a yoke, a housing having a cylindrical shape and an inner wall, and a frame-shaped suspension having four sides connected to each other and two housing attachment parts disposed on two of the four sides that are opposite of each other so as to be two-fold rotational symmetric, wherein the suspension further includes two yoke attachment parts, each yoke attachment part is disposed on a remaining opposite side of the four sides of the suspension, and each yoke attachment part is to be fixed to each of two sides of the yoke, wherein the sound reproduction unit and the magnetic circuit unit are attached to the housing, wherein the magnetic circuit unit is supported on the inner wall of the housing by the housing attachment parts of the frame-shaped suspension, and wherein the suspension includes a first pair of diagonal arms and a second pair of diagonal arms, the first pair of diagonal arms having a different shape from the second pair of diagonal arms.

* * * * *